United States Patent [19]

Clover, Jr.

[11] 4,288,006

[45] Sep. 8, 1981

[54] MULTI-COMPARTMENT CONTAINER

[75] Inventor: William M. Clover, Jr., Costa Mesa, Calif.

[73] Assignee: Dale J. Kirstine, San Juan Capistrano, Calif.

[21] Appl. No.: 798,047

[22] Filed: May 18, 1977

Related U.S. Application Data

[63] Continuation of Ser. No. 623,860, Oct. 20, 1975, abandoned.

[51] Int. Cl.[3] ..... B65D 83/04

[52] U.S. Cl. ..... 222/42; 206/534; 206/538; 222/142.9

[58] Field of Search ..... 221/5; 222/42, 142.9, 222/565; 206/534, 538, 539, 533, 540

[56] References Cited

U.S. PATENT DOCUMENTS

| | | | |
|---|---|---|---|
| 1,621,514 | 3/1927 | Mann | 222/42 |
| 2,236,224 | 3/1941 | Rashkind | 206/533 |
| 2,890,816 | 6/1959 | Horland | 222/142.9 X |
| 2,953,242 | 9/1960 | Shaw | 206/533 X |
| 2,971,681 | 2/1961 | Galbierz | 222/565 X |
| 3,561,592 | 2/1971 | McCool | 206/533 X |

*Primary Examiner*—F. J. Bartuska

*Attorney, Agent, or Firm*—Knobbe, Martens, Olson, Hubbard & Bear

[57] ABSTRACT

A vitamin dispenser having a plurality of juxtaposed storage compartments for the receipt of various types of pills or other comparable items. The somewhat cylindrical vitamin dispenser utilizes a selector cap having a selector aperture which is rotatable to an aligned position over any one of the plurality of storage compartments to allow the introduction or removal of pills from that compartment. A cover plate is mounted over the selector cap and rotatable with or relative to the selector cap to provide a cover to the selector aperture when desired. Indicia are located in conjunction with the selector cap to identify the contents of each compartment aligned below the selector aperture.

8 Claims, 8 Drawing Figures

MULTI-COMPARTMENT CONTAINER this is a continuation of application Ser. No. 623,860, filed Oct. 20, 1975, now abandoned.

BACKGROUND OF THE INVENTION

This invention relates to the field of dispensers and more particularly related to pill dispensers having a plurality of compartments for the convenient storage of various types of pills for use by an individual. With the increased use over recent years of vitamin as well as therapeutic pills it has become desirable to have a pill storage device which may be conveniently used by an individual as a dispenser of pills. Typically, the individual will be using several different vitamin or therapeutic pills, requiring a multi-compartment device that is easy to use at home or to take on a trip. An essential requisite of a pill dispenser is the ability for trouble free dispensing of the pills as well as the convenient refilling of the compartments. Furthermore, it is desirable that the container be as airtight as possible in order to preserve the freshness of the pills located in the compartments as much as possible.

SUMMARY OF THE INVENTION

The present invention comprises a frustoconical central portion having a plurality of compartments each having an upper opening over which is rotatably mounted a selector cap, having a selector aperture designed to align with each of the upper openings of the compartments to allow for the entrance or exit of pills. Located on the outside surface of each of the plurality of compartments is a label indicating the contents of each of the compartments which is viewed through an indicia window on the selector cap. The selector cap is designed to rotate completely around the upper end of the central portion of the dispenser and has a locking or maintaining mechanism which retains the selector aperture locked over the desired compartment, requiring a slight unlocking force to rotate the selector cap to another locked position over a second compartment.

Rotatably mounted on the selector cap is a cover plate having an access opening of the approximate size of the selector aperture to provide an aligned pathway with the selector aperture when it is desired to add or remove pills from a particular compartment. It should be noted that the cover plate is rotatable independent of or in conjunction with the selector cap. Because the cover plate is placed tightly adjacent the selector cap, the cover plate, when out of alignment with the selector aperture, provides a vitamin dispenser having a somewhat sealed condition, since the cover plate provides a tight cover over the selector aperture of the selector cap.

The selector cap as well as the cover plate have a general concave shape toward the bottom of the dispenser and establish a funnel configuration to aid in the reloading of the various compartments of the vitamin dispenser. Because of the rather thin construction of both the selector cap and the cover plate as well as the remainder of the dispenser the internal storage volume within the container is nearly the same as the exterior volume of the dispenser, providing an efficient storage container with respect to available internal volume versus exterior size. The dispenser also has a general frustoconical shape which allows for easier grip by the hand adjacent the top of the dispenser, while at the same time allowing for greater volume at the lower end. The overall construction of the vitamin dispenser, including the attachment of the selector cap to the central cylindrical portion of the dispenser in conjunction with the operation of the cover plate over the selector cap, provides a fairly airtight dispenser.

DETAILED DESCRIPTION OF THE INVENTION

Figure 1:
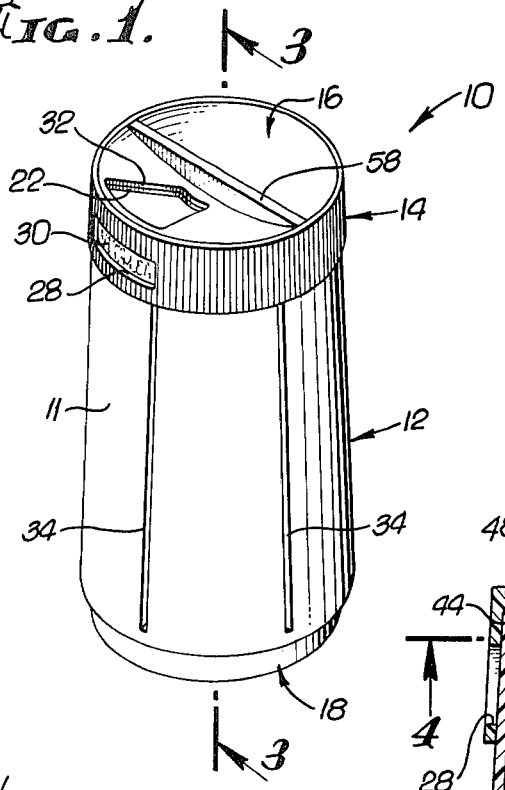
FIG. 1 is a perspective view of the vitamin dispenser invention.
Figure 5:
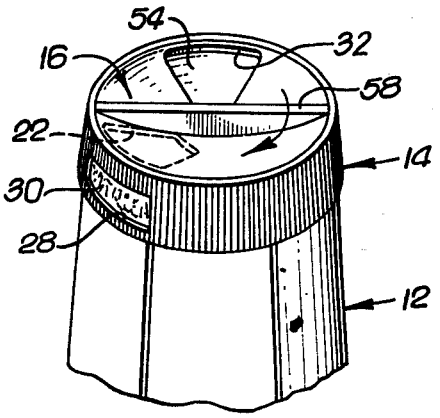
FIG. 5 is a perspective view of the cap portion of the invention.

With reference to FIG. 1 a dispenser 10 of the present invention is shown having a central portion 12 with a selector cap 14 and a cover plate 16 rotatably mounted at one end and a fixed bottom portion 18 at the other end. As shown in FIG. 5, the central portion 12 of the vitamin dispenser has a plurality of compartments 20 designed to receive different pills or other items. The selector cap 14 in FIG. 2 has a selector aperture 22 having a size approximately equal to the upper opening 24 of each of the compartments 20. The selector cap 14 has a knurled downward extending flange or skirt 26 which is designed to receive the hand of the operator in order to rotate the selector cap 14 over the various compartments 20 to the position desired with the selector aperture 22 in alignment with the appropriate upper opening 24.

Figure 3:
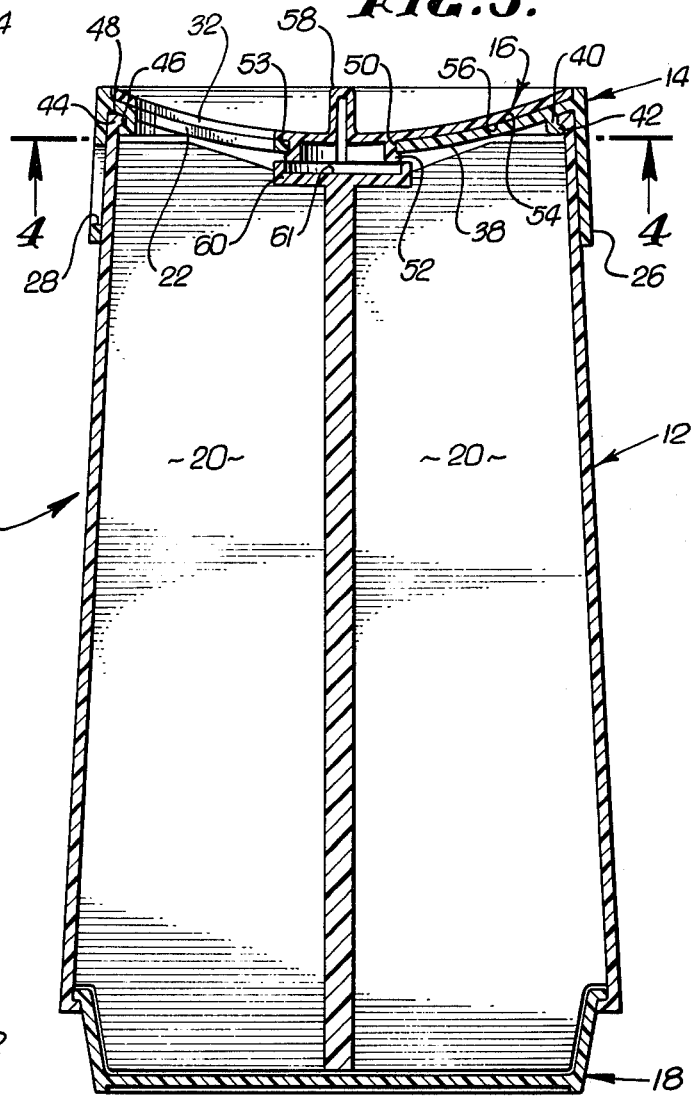
FIG. 3 is a sectional view taken along lines 3—3 in FIG. 1.

Located adjacent the selector aperture 22 in the knurled flange 26 is an indicia window 28 designed to allow viewing of a label 30, indicating the contents of the compartment below the selector aperture 22. For each of the compartments 20 there is a corresponding label 30 to identify the contents within that respective compartment. The cover plate 16 has an access aperture 32 which is of the approximate size as the selector aperture 22. Both the selector cap 14 and the cover plate 16 as shown in FIG. 3 are concave inward toward the bottom 18 of the central portion. This general concave construction establishes a funnel to aid in the reloading of the dispenser with pills when both the selector aperture 22 and access aperture 32 are aligned over one of the compartments 20.

Figure 8:
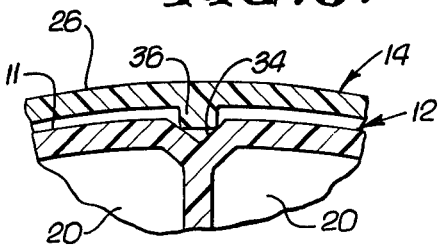
FIG. 8 is a sectional view taken along lines 8—8 of FIG. 7.
Figure 7:
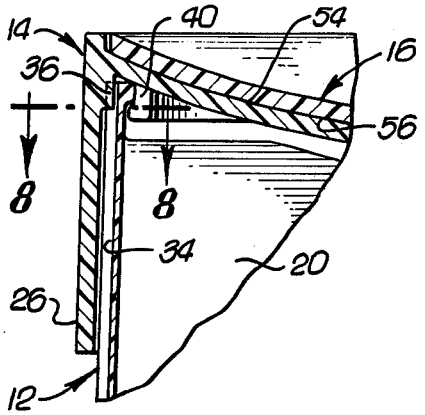
FIG. 7 is a partial vertical sectional view showing the locking mechanism between the cap and the central portion.

On the surface 11 of the central portion 12 are a series of vertical grooves 34 which generally indicate the boundaries between the various compartments 20 adjacent the surface 11. Located within the selector cap 14 is a locking ridge 36 as shown in FIGS. 7 and 8 which is designed to snap into place within each of the respective grooves 34 as the selector cap is rotated about the top of the central portion 12. The locking ridge 36 is positioned within the selector cap 14 in relation to the ndicia window 28, so that it will snap into one of the respective grooves 34 when the indicia window 28 is aligned with one of the labels 30 and when the selector aperture 22 is aligned with one of the compartments 20. The locking ridge 36 provides a means for keeping the selector aperture 22 fixed over the respective compartment 20 to allow the entry or exit of pills as desired. Each time the selector cap 14 is rotated, and the selector aperture 22 is aligned over an upper opening 24 of an adjacent compartment 20, the locking ridge 36 will again snap into engagement with another groove 34.

Figure 6:
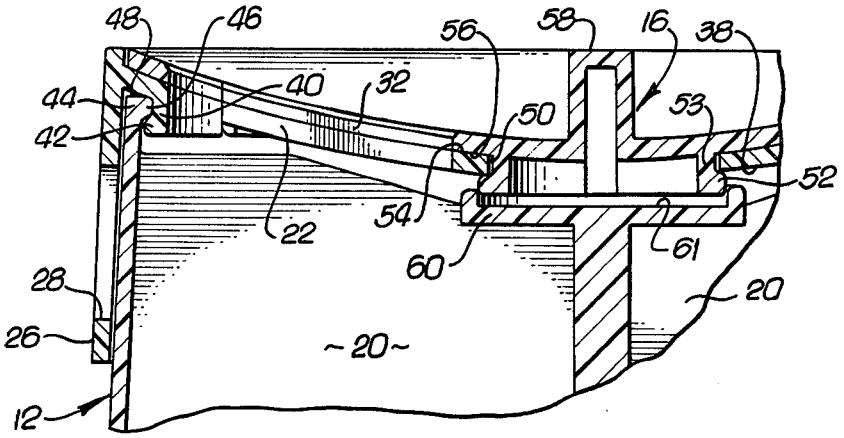
FIG. 6 is a partial vertical sectional view of the interface between the cap and the central portion of the invention.

Attention is directed to FIGS. 3 and 6 showing the selector cap 14 in sectional view with its integral downward extending knurled gripping flange 26. Extending downward beneath the lower surface 38 of the selector cap 14 is a downward extending cross-sectional L-shaped flange 40 located adjacent and spaced inwardly from the gripping flange 26. The flange 40 has a lip 42 extending radially outward away from the center of the central portion 12. The space between the flange 40 and the gripping flange 26 is designed to receive the upper end 44 of the central portion 12. Extending radially inward along the upper end 44 and toward the center of the central portion is an anchoring ridge 46 designed to engage with the lip 42 when the selector cap 14 is securely engaged with the central portion 12. The distance between the bottom surface 38 of the cap 16 and the lip 42 is essentially the same or slightly less than the vertical thickness of the anchoring ridge 46, so that, when the anchoring ridge 46 is snapped into engagement with the lip 42, the top surface 48 of the upper end 44 of the central portion is designed to seal tightly against the bottom surface 38 of the selector cap 14.

Figure 4:
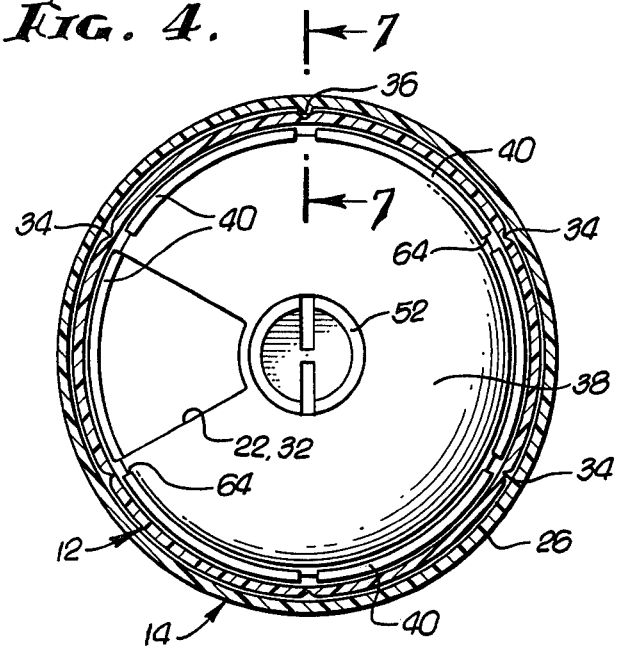
FIG. 4 is a sectional view taken along lines 4—4 in FIG. 3.

With respect to FIG. 4, the selector cap flange 40 with its lip 42 is not a continuous ring, but contains broken junction areas 64 to allow the flange sections 40 to flex and avoid any possible stresses which might otherwise break a continuous ring when the selector cap 14 is periodically removed and replaced for cleaning, etc.

Located in the center of the selector cap 14 is an aperture 50 designed to receive a downwardly extending snap ring 52 which is integrally constructed with the cover plate 16. The snap ring 52 has a slightly larger diameter than the aperture 50, so that the cover plate 16 will be secured to the selector cap 14. The neck 53 of the snap ring 52 has a diameter approximately the same or slightly smaller than the diameter of aperture 50 to allow relative rotation of the cover plate 16. The height 55 of the neck 53 is the same or slightly less than the thickness of the cap 14, so that the cover plate 16 will be in a tight relation with the cap. The cover plate 16 has the same basic concave construction as that of the selector cap 14, so that the entire upper surface 54 of the selector cap is in tight engagement with the entire lower surface 56 of the cover plate 16. Therefore, when the selector cap is moved relative to central portion 12, the cover plate 16 will follow the movement of the selector cap. On the other hand, due to the previously discussed construction of the retaining ring 52 the cover plate 16 may be moved relative to the selector cap 14 through the use of a gripping flange 58 designed to facilitate the movement of the cover plate 16 relative to the selector cap 14.

Figure 2:
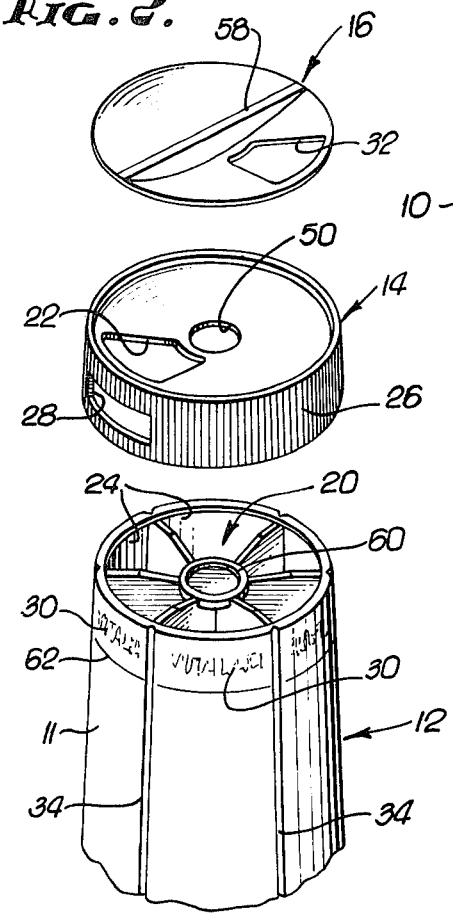
FIG. 2 is an exploded view of the invention.

In FIGS. 2 and 6 a retainer guard 60 is located at the central junction of the generally pie-shaped compartments 20 adjacent the upper openings 24 and is designed to prevent any possible spillover between the compartments as a result of a light space between the upper openings 24 and the bottom surface 38 of the cap 14. The retainer guard 60 has a slight cavity 61 which acts somewhat like a seat for the retaining ring 52 of the cover plate 16.

As a result of the tight engagement between the top edge 48 of the upper end 44 of the central portion 12 with the bottom surface 38 of the selector cap 14 in addition to the sung engagement between the top surface 54 of the selector cap and the bottom surface 56 of the cover plate, the respective compartments 20 containing the pills are kept fairly airtight to enhance the freshness and storage life of the pills within the dispenser.

With respect to FIGS. 1 and 2, attention will now be directed to the general use and operation of the vitamin dispenser invention 10. Prior to the placement of the selector cap over the upper end 44 of the central portion 12 and the loading of the pills, the respective labels 30 are accurately positioned adjacent each of the compartments 20 close to the upper openings 24 to provide accurate alignment with the indicia window 28 when it is rotated to a position adjacent the label. In order to accomplish this accurate alignment, a scribe line 62 is placed along the outer surface 11 of the central portion 12. Once the labels 30 have been placed properly about the upper end 44 of the central portion 12, the selector cap 14 is snapped into place over the upper end 44 of the central portion 12, resulting in the anchoring ridge 46 snapping into engagement with the selector cap lip 42 as shown in FIG. 3. When one is ready to load one of the compartments 20 with specific pills, the selector cap 14 is turned by holding the gripping flange 26 and turning the selector cap until the indicia window 28 reveals the label corresponding to the pills to be loaded into the dispenser. At that time the selector aperture 22 will be in alignment with the upper opening 24 of the compartment 20 to receive the specified pills. Also, the locking ridge 36 in FIG. 8 will be positioned in one of the grooves 34 to retain the selector aperture 22 accurately aligned with the upper opening 24 for loading. The cover plate 16 must be moved by gripping the flange 58 to align the access aperture 32 with the selector aperture 22. The specified pills are then poured in through the aligned apertures 32 and 22 and into the upper opening 24 of the compartment 20. The general concave shape of the selector cap 14 and the cover plate 16 acts as a funnel to aid in the loading of the pills being poured into the compartment 20.

Once that particular compartment 20 is completely filled with pills to the level just below the bottom surface 38 of the selector cap 14, the gripping flange 26 is again held securely and a force large enough is applied to the gripping flange 26 to disengage the locking ridge 36 in FIG. 8 out of the groove 34 and rotate the selector cap 14 until the locking ridge 36 again snaps into an adjacent groove 34. At this position the indicia window 28 will reveal the label of the next compartment to be filled with a different pill. Because of the engagement of the locking ridge 36 with the groove 34 at each of the respective compartments 20, the selector aperture 22 of the selector cap 14 will maintain its alignment with the upper opening 24 of that particular compartment 20. Again the next compartment is filled with the respective pills and the process is repeated throughout the plurality of the compartments within the dispenser 10. It should be noted that the cover plate 16 will move with the rotational movement of the cap 14 because of the tight contact of the top surface 54 of the cap 16 and the bottom surface 56 of the cover plate 14 as discussed previously. Therefore, the access aperture 32 will maintain alignment with the selector aperture 22.

Once all of the compartments are completely filled with the desired amount of pills, the cover plate 16 can be turned relative to the selector cap 14 so that the selector aperture 22 is covered by the cover plate 16 as shown in FIG. 5.

As shown in FIG. 3, the central portion 12 has a general frustoconical shape, so that the area adjacent the upper end 44 is easier to grip while the area adjacent the bottom portion 18 can receive a greater number of pills. It is envisioned that the various parts in the construction of the vitamin dispenser invention 10 will be constructed preferably of a polypropylene plastic type material although other suitable materials could be used.

What is claimed is:

1. A dispenser comprising:

a container body;

means defining a series of juxtaposed compartments in said container body each having an upper opening;

a selector cap rotatably mounted on said container body covering said upper openings and having a selector aperture, said selector cap having first means adapted to be gripped to manually rotate said selector cap;

a cover plate with an access aperture movably mounted on said selector cap for rotation together with and relative to said cap and having second means adapted to be gripped to manually rotate said cover plate;

third means proximate the axis of rotation of said cover plate for (a) providing a pivot axis for said cover plate relative to said selector cap, (b) maintaining said cover plate in tight relation with said selector cap and resisting relative rotation therebetween and (c) causing said cover plate to rotate with said selector cap when only said first means is gripped and manually rotates; and fourth means on said selected cap and said container body and located proximate the periphery of said selector cap for both (a) releasably maintaining said selector cap over one of said plurality of compartments and (b) requiring an unlocking force greater than the resisting force of said third means for preventing said selector cap from rotating with said cover plate when only said second means is gripped and manually rotated.

2. A dispenser as defined in claim 1, wherein said cover plate has an inward concave shape from the top of said dispenser, said concave shape establishing a funnel to enhance the filling of, and dispensing from, each of said plurality of compartments separately and individually.

3. A dispenser as defined in claim 1, wherein said fourth means comprises a locking rib on one of said selector cap and said series of compartments and a series of separated detents located on the other of said selector cap and said series of compartments, so that each time said locking rib is received in one of said detents, (a) said selector aperture is aligned with one of said upper openings of said plurality of compartments, and (b) said selector cap is held firmly in place so that said cover plate may be rotated independently of said selector cap when only said plate is rotated.

4. A dispenser as defined in claim 1, wherein said selector cap has a depending skirt extending down from the outside edge of said cap and along the outside surface of said series of compartments, said skirt having a knurled surface to enhance the grip of an individual to rotate said selector cap.

5. A dispenser as defined in claim 4, wherein said skirt has an indicia window to reveal at each position of said selector aperture over said compartments a label of the contents of said compartment.

6. A dispenser comprising:

a frustoconical central portion having a plurality of compartments with upper openings adjacent the top edge of said central portion;

a selector cap rotatably mounted on said central portion adjacent said upper openings, said selector cap having a selector aperture, each of said upper openings being no larger than said selector aperture;

a locking member connected to one of said cap and said central portion;

a series of detents on the other of said cap and said central portion, said locking member and said series of detents acting cooperatively to releasably lock said selector cap on said central portion to maintain alignment between said selector aperture and one of said upper openings for the placement or removal of contents;

a cover plate rotatably mounted on said selector cap for rotation together with and relative to said cap, said cover plate having an access aperture and having first means adapted to be gripped to manually rotate said cover plate;

indicia located on the exterior surface of said central portion adjacent each of said upper openings to label the contents of each of said compartments;

a gripping skirt extending down from said cap adjacent said top end of said central portion, said skirt covering said indicia and having a viewing window to reveal said label of said compartment over which said selector aperture is situated;

second means proximate the axis of rotation of said cover plate for (a) providing a pivot axis of said cover plate relative to said selector cap, (b) maintaining said cover plate in tight relation with said selector cap resisting relative rotation therebetween, and sealing the contents of the dispenser from outside air, moisture, and contaminants, and (c) causing said cover plate to rotate with said selector cap when said gripping skirt is gripped and manually rotated; and said locking member and said series of detents requiring an unlocking force greater than the resisting force of said second means so that said selector cap is prevented from rotating with said cover plate when only said first means is gripped and manually rotated.

7. A dispenser as defined in claim 6 wherein said cap and said cover plate are concave inward toward said compartments, the centers of said cap and said cover plate being in a lower horizontal plane than said top edge of said central portion forming a funnel for the loading and dispensing of the contents of each of said compartments separately and individually.

8. A dispenser as defined in claim 7 and additionally comprising:

an anchoring rib connected to and spaced downward from the bottom surface and inward of the outer periphery of said cap and facing toward the outer periphery of said cap; and a locking ridge located adjacent said upper edge of said central portion and facing toward the center of said central portion placement of said locking ridge in engagement above and with said anchoring rib causing said top edge to seal against said bottom surface of said cap, for preventing the exposure of the contents of the dispenser to outside air, moisture and contaminants.

* * * * *